US012734429B1

(12) United States Patent
Smith et al.

(10) Patent No.: US 12,734,429 B1
(45) Date of Patent: Sep. 15, 2026

(54) GRIP APPARATUS FOR A GOLF CLUB

(71) Applicant: SWINGSMITH LLC, Jefferson City, MO (US)

(72) Inventors: Osborne Earl Smith, St Louis, MO (US); David Wayne Watkins, Jr., Rolla, MO (US); Joseph Douglas Lopez, Jefferson City, MO (US)

( * ) Notice: Subject to any disclaimer, the term of this patent is extended or adjusted under 35 U.S.C. 154(b) by 28 days.

(21) Appl. No.: 19/081,237

(22) Filed: Mar. 17, 2025

(51) Int. Cl.
*A63B 71/14* (2006.01)

(52) U.S. Cl.
CPC ..... *A63B 71/146* (2013.01)

(58) Field of Classification Search
CPC ... A63B 71/146; A63B 71/14; A63B 69/3608; A63B 57/00; A63B 60/54; A63B 69/36; A41D 19/002; A41D 19/01523; A41D 19/01547; A41D 19/01558
USPC ..... 2/161.2, 161.3, 20
See application file for complete search history.

(56) References Cited

U.S. PATENT DOCUMENTS

| | | | | | |
|---|---|---|---|---|---|
| 1,483,595 | A | | 2/1924 | Read | |
| 1,690,312 | A | | 11/1928 | Rosan | |
| 2,302,875 | A | * | 11/1942 | Lykins | A63B 71/146 2/161.3 |
| 2,456,678 | A | * | 12/1948 | Cole | A63B 71/146 D29/113 |
| 2,465,136 | A | * | 3/1949 | Troccoli | A63B 71/146 2/161.3 |
| 3,900,199 | A | | 8/1975 | Mcgonagle | |
| 3,922,724 | A | | 12/1975 | Shockovsky | |
| 4,057,255 | A | | 11/1977 | Bishop | |
| 4,329,741 | A | * | 5/1982 | Bach | A63B 71/146 2/161.2 |
| 4,461,043 | A | | 7/1984 | Lomedico | |
| 4,748,690 | A | * | 6/1988 | Webster | A63B 71/143 2/161.1 |
| 5,069,454 | A | * | 12/1991 | Frost | A63B 60/08 473/206 |
| 5,108,103 | A | | 4/1992 | Rilling | |
| 5,159,717 | A | | 11/1992 | Drew | |
| 5,180,165 | A | | 1/1993 | Frost | |
| 5,322,286 | A | | 6/1994 | Frost | |
| 5,377,984 | A | | 1/1995 | Ciccia | |
| 5,401,017 | A | | 3/1995 | Mcdonald | |
| 5,588,651 | A | | 12/1996 | Frost | |
| 5,604,934 | A | | 2/1997 | Willett | |
| 5,797,803 | A | | 8/1998 | Jung | |
| 5,855,022 | A | * | 1/1999 | Storto | A63B 71/146 2/161.2 |
| 5,895,326 | A | | 4/1999 | Cozza | |

(Continued)

FOREIGN PATENT DOCUMENTS

| | | | | |
|---|---|---|---|---|
| GB | 2232338 A | * | 12/1990 | A63B 71/146 |
| KR | 200357986 Y1 | * | 8/2004 | A41D 19/01582 |

(Continued)

*Primary Examiner* — Alissa J Tompkins
(74) *Attorney, Agent, or Firm* — James A Cardle

(57) ABSTRACT

The golf club grip apparatus disclosed herein includes a body defining a surface configured to engage biasingly only portions of a golfer's palm about a thenar region. The body defines an opposing surface configured to biasingly engage at least in part a handle of a golf club. The body is configured to generally fills at least portions of a thenar space formed as the golfer grips the golf club.

6 Claims, 5 Drawing Sheets

(56) References Cited

U.S. PATENT DOCUMENTS

| | | | | |
|---|---|---|---|---|
| 5,926,847 | A * | 7/1999 | Eibert | A63B 71/146 2/161.2 |
| 5,954,591 | A | 9/1999 | Liberatore | |
| 6,260,198 | B1 | 7/2001 | Lomedico | |
| 6,427,246 | B1 | 8/2002 | Doi | |
| 7,000,259 | B2 | 2/2006 | Matechen | |
| 7,128,656 | B1 | 10/2006 | Orchel | |
| 7,377,566 | B2 | 5/2008 | Gazaui | |
| 7,469,426 | B2 * | 12/2008 | Roeckl | A41D 19/01523 2/161.6 |
| 7,836,839 | B2 | 11/2010 | Park | |
| 7,963,864 | B2 | 6/2011 | Frost | |
| 8,146,173 | B2 | 4/2012 | Kim | |
| 8,376,872 | B1 | 2/2013 | Murphy | |
| 8,852,033 | B1 | 10/2014 | Frost | |
| 9,549,836 | B2 | 1/2017 | Anglada | |
| 9,603,394 | B2 | 3/2017 | Lomedico | |
| 9,899,012 | B2 | 2/2018 | First | |
| 10,212,976 | B2 | 2/2019 | Bailey | |
| 10,645,984 | B2 | 5/2020 | Hull | |
| 11,291,907 | B2 | 4/2022 | Rocks | |
| 11,844,384 | B1 | 12/2023 | Price | |
| 12,053,039 | B2 | 8/2024 | Hull | |
| 12,070,674 | B1 | 8/2024 | Restko | |
| 12,220,010 | B2 * | 2/2025 | Villarreal | A63B 71/146 |
| 2004/0068777 | A1 | 4/2004 | Wheelington | |
| 2005/0121927 | A1 | 6/2005 | Gazaui | |
| 2005/0229285 | A1 * | 10/2005 | Chung | A41D 19/01564 2/161.2 |
| 2011/0224009 | A1 | 9/2011 | Shan | |
| 2011/0265239 | A1 * | 11/2011 | Kanemitsu | A63B 71/143 2/163 |
| 2013/0190097 | A1 | 7/2013 | Shealy | |
| 2014/0221114 | A1 | 8/2014 | Woody | |
| 2015/0313298 | A1 * | 11/2015 | Bailey | A41D 19/01564 2/168 |
| 2017/0361184 | A1 | 12/2017 | Roy | |
| 2018/0055108 | A1 | 3/2018 | Long | |
| 2019/0223527 | A1 * | 7/2019 | George | A41D 19/01547 |
| 2021/0299544 | A1 * | 9/2021 | Rocks | A41D 19/015 |
| 2023/0042758 | A1 | 2/2023 | Csendes | |
| 2023/0062461 | A1 | 3/2023 | Jung | |
| 2023/0149198 | A1 | 5/2023 | Frederick | |
| 2023/0330509 | A1 | 10/2023 | Lomedico | |
| 2023/0371628 | A1 | 11/2023 | Villarrea | |

FOREIGN PATENT DOCUMENTS

| | | | | |
|---|---|---|---|---|
| KR | 200397896 | Y1 * | 10/2005 | A41D 19/01523 |
| KR | 20070054074 | A * | 5/2007 | A63B 71/146 |
| KR | 20100114773 | A * | 10/2010 | A63B 71/146 |
| KR | 20150086045 | A * | 7/2015 | A63B 71/146 |
| WO | WO2003078003 | A1 | 9/2003 | |
| WO | WO2008075875 | A1 | 6/2008 | |
| WO | WO2014120531 | A1 | 8/2014 | |
| WO | WO2020227511 | A1 | 11/2020 | |

* cited by examiner

GRIP APPARATUS FOR A GOLF CLUB

BACKGROUND OF THE INVENTION

Field

This disclosure relates to golf accessories, and, in particular, to an apparatus that enhances the golfer's grip of a golf club.

Background

Enhancing the golfer's grip of a golf club during a golf stroke may enhance the golfer's performance. The term golf stroke, as used herein, may include contact between the golf club and a golf ball such as, for example, the entire full or modified golf swing and putting motions that may pass through the frontal, parasagittal, and transverse planes. Golf stroke, as used herein, includes all strokes (e.g., drives, fairway shots, shots from the rough or otherwise, chips, pitches) and putts. Golf stroke, swing, stroke, golf swing, shot, and similar terms may be used interchangeably through this specification.

An exemplary grip of handle 97 of golf club 90 by a right handed golfer is illustrated in FIG. 1. Note that the hands as illustrated partially overlay each other and the thumbs are aligned with the handle 97 oriented toward the head (not shown) of the golf club 90. The placement of the hands is the reverse of that illustrated in FIG. 1 for a left handed golfer.

Increasing hand contact with the handle of the golf club while gripping the handle of the golf club, for example, in the manner illustrated in FIG. 1, may increase control of the golf club during the golf stroke. Control of the golf club during the golf stroke may be important for accuracy, distance, and consistency. Increasing hand contact with the club resulting in increased control of the club by the hands may, thus, enhance the golfer's play.

Accordingly, there is a need for improved apparatus for engagement of the hand or hands with the handle of the golf club as well as related methods of use.

BRIEF SUMMARY OF THE INVENTION

These and other needs and disadvantages may be overcome by the golf grip apparatus disclosed herein. Additional improvements and advantages may be recognized by those of ordinary skill in the art upon study of the present disclosure.

In various aspects, the golf club grip apparatus disclosed herein includes a body defining a surface configured to engage biasingly only portions of a golfer's palm about a thenar region. The body defines an opposing surface configured to biasingly engage, at least in part, a handle of a golf club, in various aspects. The body is configured to generally fill at least portions of a thenar space formed as the golfer grips the golf club, in various aspects. In various aspects, the body has a maximum width at an end coterminous with a purlicue of the hand and tapers to an opposing end formed as a vertex and generally disposed between a radial longitudinal crease and a proximal transverse crease at an opposing end.

This summary is presented to provide a basic understanding of some aspects of the apparatus and methods disclosed herein as a prelude to the detailed description that follows below. Accordingly, this summary is not intended to identify key elements of the apparatus and methods disclosed herein or to delineate the scope thereof.

Figure 1:
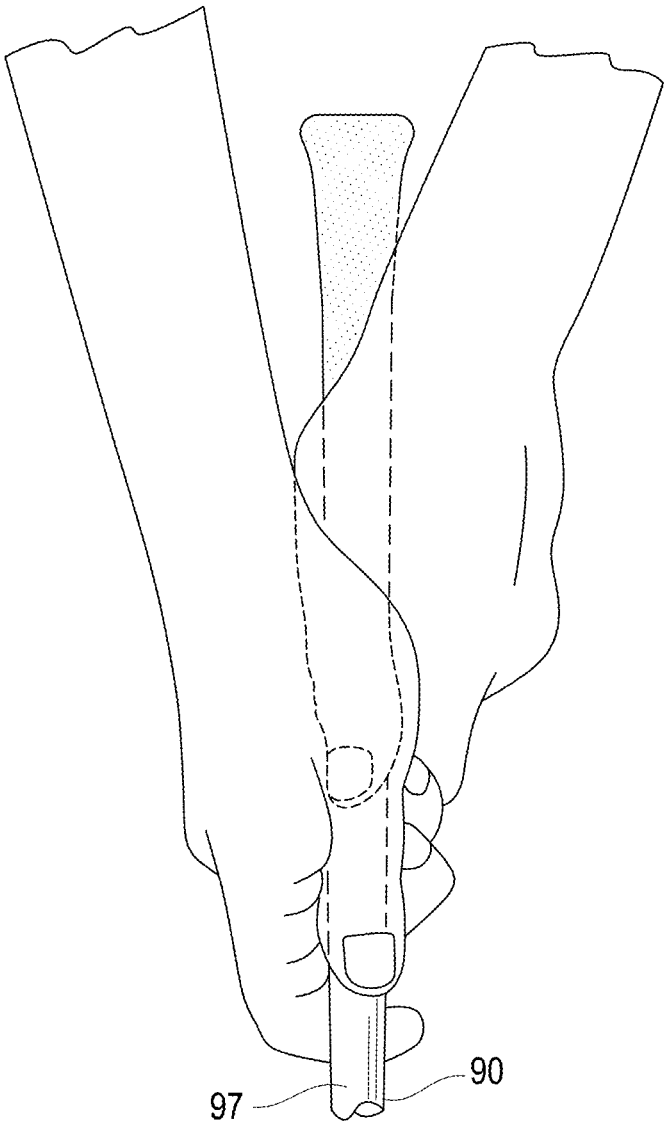
FIG. 1 illustrates by perspective view an exemplary hand placement of a right handed golfer gripping a handle of a golf club (note that an exemplary hand placement for a left handed golfer is the reverse of that illustrated in FIG. 1)

The Figures are exemplary only, and the implementations illustrated therein are selected to facilitate explanation. The number, position, relationship and dimensions of the elements shown in the Figures to form the various implementations described herein, as well as dimensions and dimensional proportions to conform to specific force, weight, strength, flow and similar requirements are explained herein or are understandable to a person of ordinary skill in the art upon study of this disclosure. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances such as ±0.1%, ±1%, ±2.5%, ±5%, or other such tolerances, as would be recognized by those of ordinary skill in the art upon study of this disclosure.

DETAILED DESCRIPTION OF THE INVENTION

The golf club grip apparatus disclosed herein includes a body configured to fill generally a thenar space, which is a void between the thenar region of a palm of a hand and a handle of a golf club that may naturally occur when the golfer grips the handle of the golf club. By generally filling the thenar space, the golf club grip apparatus may increase hand contact with the handle of the golf club and reduce variations in gripping the handle of the golf club by the hand thereby forming a more balanced and solidified grip while decreasing and distributing the stress of the handle on the hand during a stroke. For example, absent the golf club grip apparatus, stresses from the handle during the stroke may primarily be emphasized on the little, ring, and middle fingers. The golf club grip apparatus may, for example, distribute stresses from the handle more broadly over the palm of the hand giving the golfer a better feel for the golf club during the stroke thereby resulting in more accurate contact and a more consistent stroke. The golf club grip apparatus may, for example, assist in gripping the handle of the golf club thereby maintaining control of the golf club during the stroke. The golf club grip apparatus may, for example, increase consistency of the hands during the stroke, and, thus, consistency of the stroke. In summary, the golf club grip apparatus disclosed herein may increase the consistency of the stroke by improving and stabilizing the golfer's grip on the handle of the golf club and distributing the pressure of the golf club over the hand.

Figure 2A:
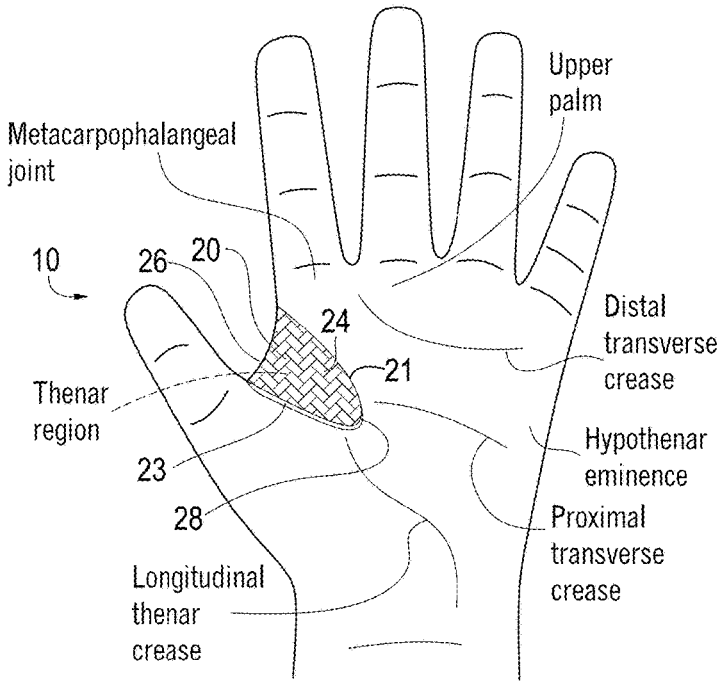
FIG. 2A illustrates by perspective view an exemplary implementation of a golf club grip apparatus according to aspects of the present invention.
Figure 2B:
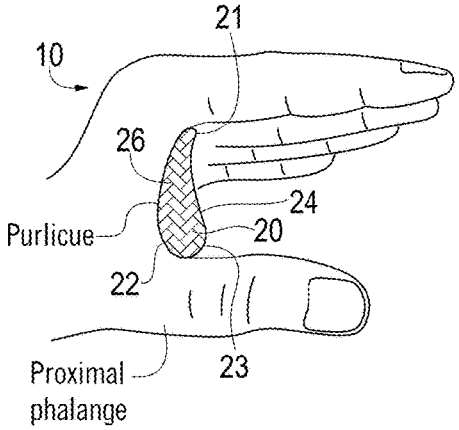
FIG. 2B illustrates by another perspective view the exemplary implementation of the golf club grip apparatus of FIG. 2A.

As illustrated in FIGS. 2A, 2B, exemplary golf club grip apparatus 10 includes body 20. In this implementation, body 20 of golf club grip apparatus 10 stands alone in engagement with the thenar region of the palm of the golfer (e.g., the hand is otherwise bare apart from body 20 in this implementation). By contrast, in golf club grip apparatus 100, 200, body 120, 220, cooperates with glove 140, 240, respectively (see FIGS. 5, 6) to engage the thenar region of the palm of the golfer. As illustrated in FIGS. 2A, 2B, body 20 of golf club grip apparatus 10 defines surface 22 that biasingly engages portions of the golfer's palm including at least portions of the thenar region of the palm to fill essentially the natural void(s) or gap(s) formed between the hand and the handle in the thenar space as the golfer grips handle 97. Opposing surface 24 of body 20 is oriented outward from the palm to engage handle 97 of golf club 90 when handle 97 is gripped by the golfer. Thus, body 20 is configured to fill essentially the thenar space 57 (e.g., the gap between handle 97 and the thenar region of the palm—also see FIG. 3A) thereby providing additional and continuous contact between the thenar region of the palm and handle 97 (e.g., minimal or no gap(s) or void(s) between the hand and handle 97).

Figure 2C:
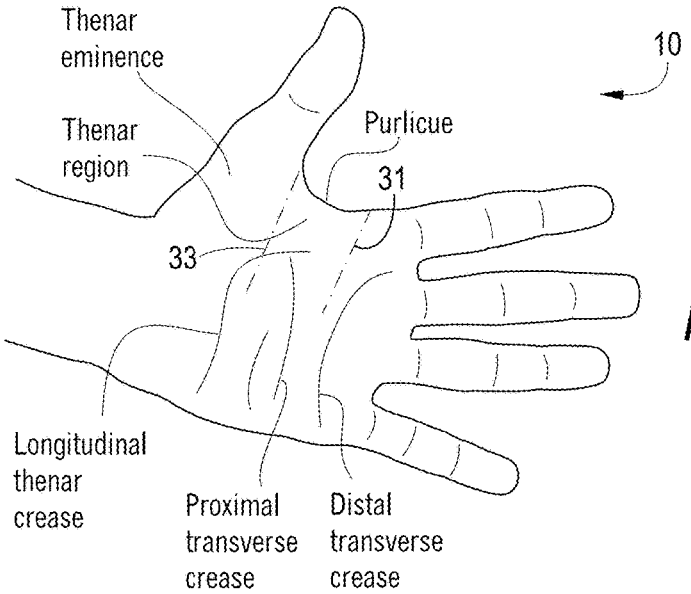
FIG. 2C illustrates generally by perspective view a region of engagement of the exemplary implementation of the golf club grip apparatus of FIG. 2A with a palm of a hand.
Figure 5:
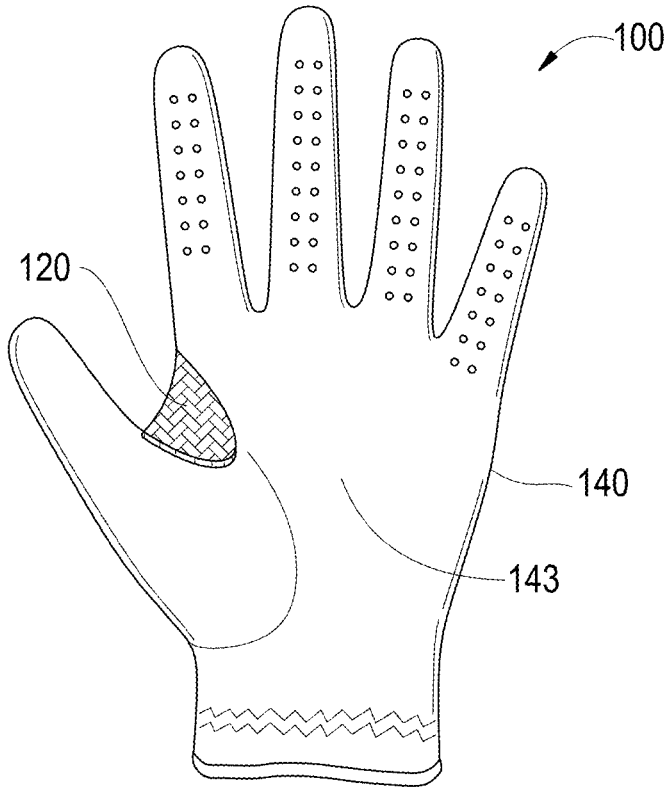
FIG. 5 illustrates a second exemplary implementation of a golf club grip apparatus according to aspects of the present invention; and, FIG. 6 illustrates a third exemplary implementation of a golf club grip apparatus according to aspects of the present invention.
Figure 6:
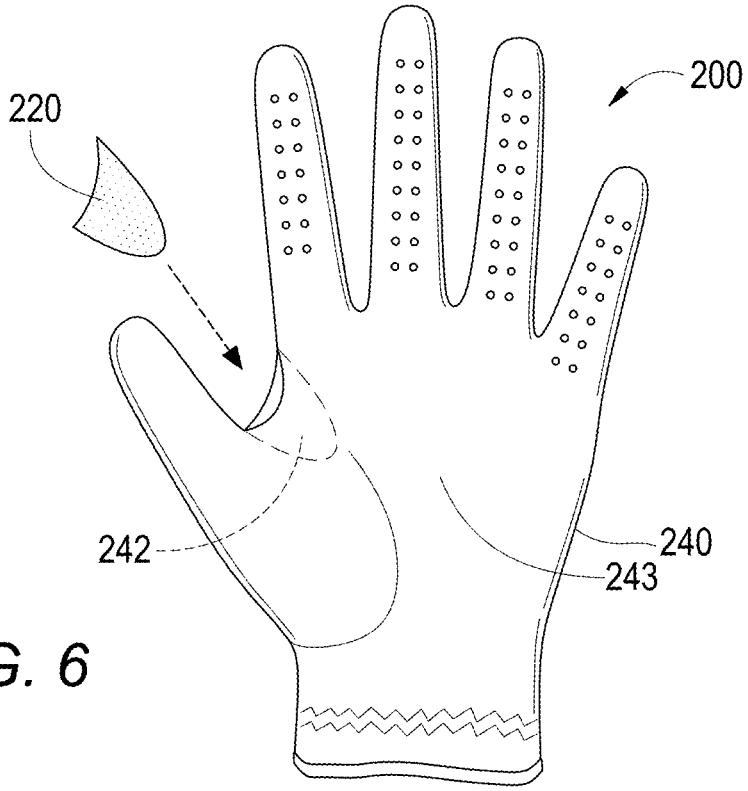

FIGS. 2A, 2B, 2C illustrate an exemplary left hand of the golfer including some anatomical features thereof. Exemplary body 20 of exemplary golf grip apparatus 10 is illustrated in FIGS. 2A, 2B, 2C, 3A, 3B, 3C, 4A, 4B, 4C in cooperation with the thenar region of the palm of the left hand for purposes of explanation. Similarly, exemplary golf grip apparatuses 100, 200 are illustrated in FIGS. 5, 6, respectively, in cooperation with a left hand for explanatory purposes. It should be understood that implementations of the golf grip apparatus disclosed herein, including exemplary golf club grip apparatuses 10, 100, 200, may configured for use with either hand, whether dominant or non-dominant, and that implementations of the golf grip apparatus may be configured for use with both hands simultaneously.

As illustrated in FIG. 2A, 2B, end 26 of body 20 is generally coterminous with a purlicue of the hand with end 26 being generally aligned along the purlicue between a proximal phalange of the thumb and a base of a metacarpophalangeal joint (knuckle) of the index finger with body 20 in cooperation with the thenar region of the palm of the hand. End 26 does not enclose the purlicue, as illustrated, but only extends on the palm to the purlicue. By being coterminous with the purlicue, there is no webbing between thumb and forefinger in exemplary golf club grip apparatus 10, as webbing between the thumb and forefinger may be restrictive and, thus, undesirable. Body 20 does not engage the thumb or the forefinger (or any of the other fingers), as illustrated, because engagement of the thumb and/or fingers may be interfere with gripping of handle 97 (also see FIGS. 3A, 3B, 3C). Lines 31, 33 of FIG. 2C generally indicate the thenar region within which body 20 may be engaged with the palm. Line 33, as illustrated in FIG. 2C, extends along the base of the thumb proximal of the proximal phalange of the thumb and line 31 extends proximal of the metacarpophalangeal joint (knuckle) of the index finger. Line 31 may further extend proximally of the metacarpophalangeal joint of the middle finger and line 31 may further extend proximally of the metacarpophalangeal joint of the ring finger, in other embodiments. Body 20 may then engage the palm generally between lines 31, 33. Boundary 21 (also see FIG. 4A) of body 20 may generally coincide about line 31 or be proximal (e.g., toward the thenar region) of line 31, and boundary 23 (also see FIG. 4A) of body 20 may generally coincide with line 33 or be proximal (e.g., toward the thenar region) of line 33, in various implementations. Note that, while lines 31, 33 are used to indicate the thenar region that receives body 20 for explanatory purposes, boundaries 21, 23 of exemplary body 20 may be linear, curved, or combinations thereof, in various implementations. Lines 31, 33 are indicative and used for explanatory purposes, so that it should be understood at least portions of body 20 may fall on either side of lines 31, 33, in various implementations.

Figure 4A:
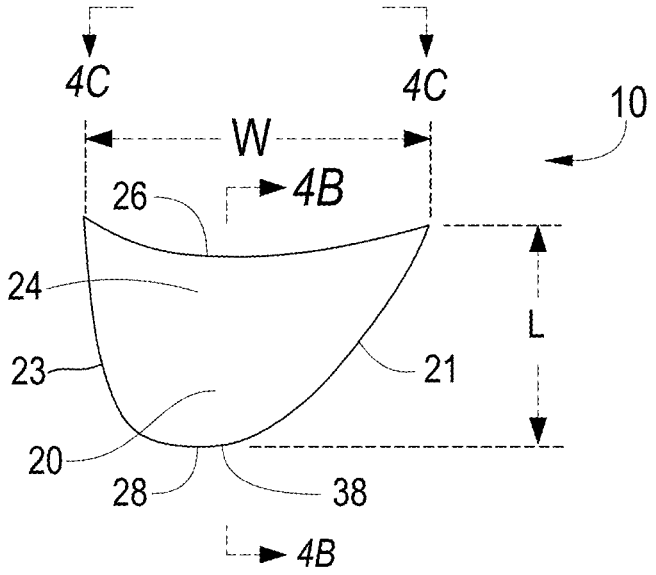
FIG. 4A illustrates by upper plan view a body of the exemplary implementation of the golf club grip apparatus of FIG. 2A.

Body 20 at end 26 has width W, as illustrated in FIG. 4A. As illustrated, body 20 tapers from width W decreasing toward opposing end 28 that lies generally along a radial longitudinal crease (longitudinal thenar crease) of the palm or between the radial longitudinal crease and the proximal transverse crease, as illustrated in FIG. 2A. In this implementation, body 20 assumes somewhat of a parabolic shape with opposing end 28 forming generally vertex 38 of parabolic boundaries 21, 23. Accordingly, body 20 is mainly engaged with the thenar region of the palm and generally avoids the upper palm, the thenar eminence, and the hypothenar eminence, in this implementation. Note that, as illustrated, body 20 only engages portions of the palm generally in the thenar region, and that body 20 does not engage the thumb or finger(s) nor does body 20 engage any portion of the dorsal side (e.g., back) of the hand.

Figure 3A:
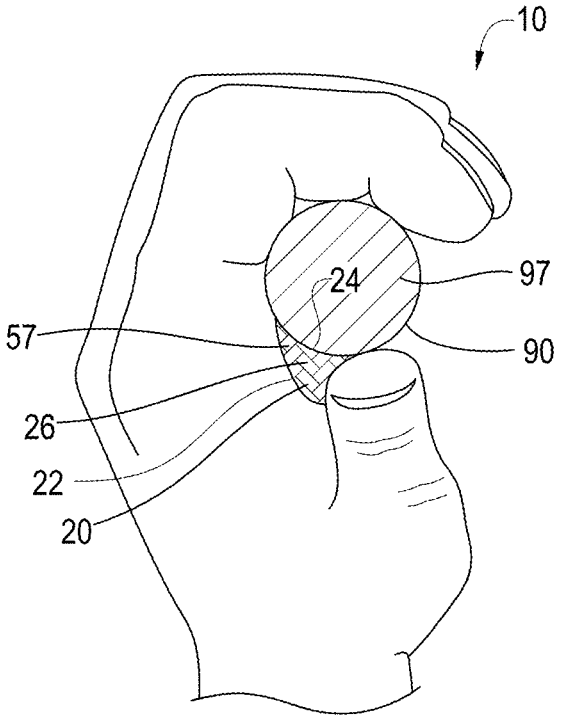
FIG. 3A illustrates by perspective view the exemplary implementation of the golf club grip apparatus of FIG. 2A in cooperation with a golfer's hand gripping a handle of a golf club.
Figure 3B:
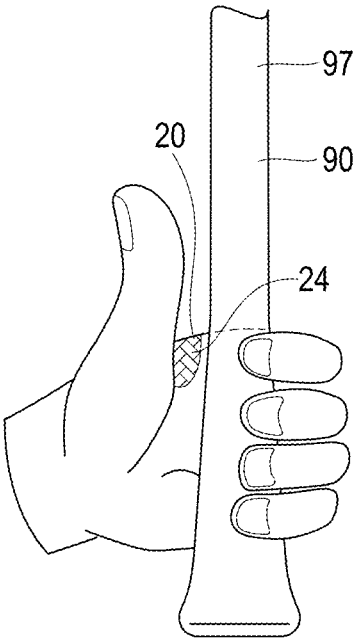
FIG. 3B illustrates by perspective view the exemplary implementation of the golf club grip apparatus of FIG. 2A in cooperation with a golfer's hand assuming a type of grip upon the handle of a golf club.
Figure 3C:
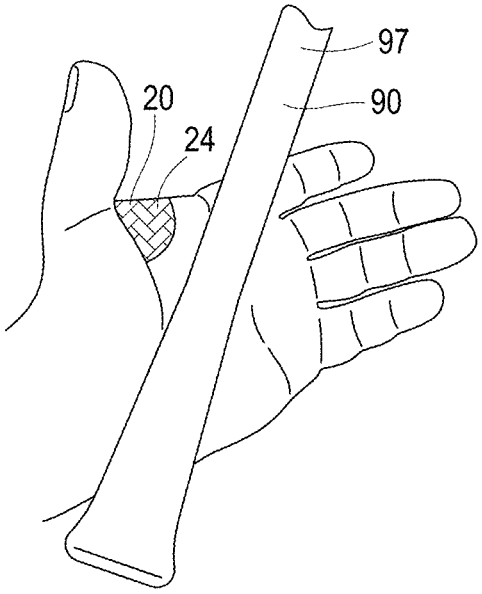
FIG. 3C illustrates by perspective view the exemplary implementation of the golf club grip apparatus of FIG. 2A in cooperation with a golfer's hand assuming another type of grip upon the handle of a golf club.

FIGS. 3A, 3B, 3C illustrates a bare left hand including body 20 gripping handle 97 of golf club 90. As illustrated in FIG. 3A, the thumb is axially aligned with handle 97 and oriented toward a club head (not shown) of golf club 90 also as per FIG. 1. Surface 22 of body 20 is engaged with portions of the palm and opposing surface 24 of body 20 is engaged with handle 97 to fill the thenar space 57, as illustrated in FIG. 3A. Body 20 may be formed of a deformable material in order to deform in conformance with the thenar space 57 as the golfer grips handle 97 without interfering with gripping handle 97 by, for example, requiring the golfer to apply significant additional gripping force. Body 20 may be sized and be made sufficiently deformable to fill generally thenar space 57 between the thenar region and handle 97 without altering a position of the hand with respect to handle 97 from a position the hand would assume absent body 20 or otherwise interfering with gripping of handle 97. For example, body 20 may be formed of materials such as, for example without limitation, leather, rubber, soft plastic, or foam such as a polyurethane foam. Body 20 may be formed of an absorbent material to absorb sweat from the hand(s). In certain implementations, body 20, for example, may have a hardness within a range of about 20 to about 80 on the Shore 00 scale.

FIG. 3B illustrates the golfer assuming a grip upon handle 97 with handle 97 aligned with the finger tips and corresponding to FIG. 3A. The grip is being assumed in FIG. 3B for purposes of explanation, so that the grip as illustrated in FIG. 3B is not fully completed. This gripping of handle 97 of FIG. 3B may be considered a beginner's grip that may increase the thenar space 57 that is then filled by body 20. FIG. 3C illustrates a more advanced grip of handle 97 with handle 97 passing more longitudinally across the palm between the wrist and the metacarpophalangeal joint of the index finger. Again, the grip is being assumed by the golfer as illustrated in FIG. 3C for purposes of explanation, so that the grip as illustrated in FIG. 3C is not fully completed. The more advanced FIG. 3C grip may decrease the thenar space 57 to be filled by body 20. Accordingly, the size and shape of body 20 may vary depending upon the grip because the thenar space 57 being filled by body 20 may vary depending upon the grip.

Figure 4B:
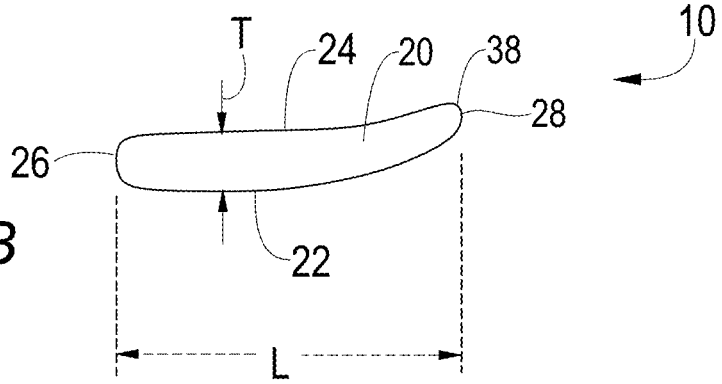
FIG. 4B illustrates the body of FIG. 4A by cut-away cross sectional view.
Figure 4C:
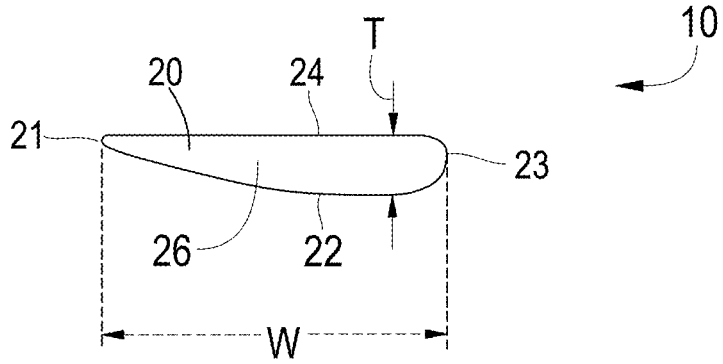
FIG. 4C illustrates the body of FIG. 4A by an end view.

The implementation of exemplary body 20 for the left hand is further illustrated in FIGS. 4A, 4B, 4C. In general, body 20 may be configured to conform to the thenar region in order to fill-in and/or level-out the thenar region of the golfer's palm. In this implementation, for example, body 20 levels out the thenar region in order to present a generally flat opposing surface 24 for engagement with handle 97 of golf club 90. For example, body 20 flattens out the thenar region of the palm. The size and shape of body 20 may vary in different implementations depending, for example, upon the size and configuration of the golfer's hand. As illustrated in FIG. 4A, end 26 of body 20 curves to align with the purlicue, with the portion of body 20 where end 26 adjoins boundary 23 being proximate the thumb and the portion of body 20 where end 26 adjoins boundary 21 being proximate the index finger when body 20 is received by the palm of the hand. End 26 is curved between surface 22 and opposing surface 24, as illustrated in FIG. 4B, but end 26 may be more flat or planar in other implementations. As illustrated in FIG. 4C, surface 22 curves to intersect opposing surface 24 with the intersection of surface 22 with opposing surface 24 defining boundaries 21, 23. In various other implementations, boundaries 21, 23 may be configured, for example, as flat surface(s) or edged, at least in part. Boundaries 21, 23 define a parabolic shape of body 20 tapering from end 26 toward opposing end 28 as vertex 38, as illustrated in FIG. 4A. Opposing end 28 of body 20, which is rounded in this implementation, may be located within the thenar region or slightly within the middle palm generally proximate the thenar region when body 20 is received by the palm of the hand. Length L of body 20 may be selected and body 20 may be shaped to position opposing end 28 within the thenar region or slightly within the middle palm.

As illustrated in FIG. 4B, thickness T of body 20 between surface 22 and opposing surface 24 is maximum at end 26, and thickness T decreases generally between end 26 and opposing end 28 so that thickness T is a minimum at opposing end 28. Opposing surface 24 is generally flat with perhaps a slight curvature proximate opposing end 28, as illustrated, to engage hande 97 of golf club 90. Opposing surface 24 is curved to fill in the thenar region by conforming to the thenar region in order to present opposing surface 24 to handle 97 as generally flat, as illustrated. For example, thickness T of body 20 may range between about 1 mm and about 10 mm although greater thicknesses may be required, for example, to accommodate larger hand(s). In one exemplary implementation, for example, thickness T is about 8 mm at its maximum proximate end 26 decreasing to about 3 mm proximate opposing end 28. Thickness T of body 20 at end 26 is a maximum proximate boundary 23 decreasing curvingly toward boundary 21, as illustrated in FIG. 4C.

Width W of body 20 may be selected so that end 26 is generally in coterminous alignment with the purlicue with body 20 avoiding the proximal phalange of the thumb and the base of the metacarpophalangeal joint (knuckle) of the index finger. For example, in one implementation, width W is about 40 mm. Length L may be selected and body 20 shaped so that opposing end 28 that lies generally along the radial longitudinal crease (longitudinal thenar crease) of the palm or between the radial longitudinal crease and the proximal transverse crease. Opposing end 28 may be located within the thenar region or slightly within the middle palm generally towards the thenar region while avoiding the hypothenar region of the palm. For example, length L is about 50 mm, in one exemplary implementation. For example, width W may range between about 24 mm and about 46 mm, and length L may range between about 30 mm and about 60 mm, in various implementations. In various implementations, the width W and length L may vary commensurate with the hand size of the golfer, as indicated in exemplary Table 1. Table 1 lists glove sizes for men and women including WS (women small), WM (women medium), WL (women large), MS (men small), MM (men medium), ML (men large), and MXL (men extra large) along with exemplary corresponding width W and length L of body 20.

TABLE 1

| Sizes (Men/Women) MXL (+15%) | Length L boundary by thumb 57.5 mm | Width W along purlicue 46 mm | Hypotenuse 58.65 mm |
|---|---|---|---|
| ML | 50 | 40 | 51 |
| MM/WL | 45 | 36 | 45.9 |
| MS/WM | 40 | 32 | 40.8 |
| WS | 30 | 24 | 30.6 |

As illustrated in FIG. 5, exemplary golf club grip apparatus 100 includes body 120 secured to glove 140 so that body 120 is disposed only about the thenar region of the palm as per body 20 of exemplary golf club grip apparatus 10 when glove 140 is received by the hand. Body 120 generally avoids the upper palm, the thenar eminence, and the base(s) of the metacarpophalangeal joint(s) when glove 140 is received by the hand. Note that body 120 is external to palm side 143 of glove 140, in this implementation, so that body 120 directly engages the handle of the golf club, such as handle 97 of golf club 90, and glove 140 is interposed between body 120 and the palm. In other implementations, body 120 may be disposed on palm side 143 within glove 140 so that, for example, body 120 directly engages the palm of the golfer's hand and glove 140 is interposed between body 120 and the handle of the golf club. Body 120 may be secured to glove 140 by stitching, adhesive, hook and loop fastener, combinations thereof, or various other ways, as would be readily recognized by those of ordinary skill in the art upon study of this disclosure. Body 120 does not directly engage the fingers, the thumb, or the dorsal side of the hand, in this implementation. Body 120 is coterminous with the purlicue as is glove 140, so that there is no webbing between thumb and forefinger in exemplary golf club grip apparatus 100 as such webbing may impede proper gripping of the golf club.

As illustrated in FIG. 6, exemplary golf club grip apparatus 200 includes body 220 received within chamber 242 of glove 240 so that body 220 is disposed about the thenar region of the palm avoiding generally the upper palm, the thenar eminence, and the base(s) of the metacarpophalangeal joint(s) when glove 240 is received by the hand. Body 220 is disposed about the hand similarly to body 20 of exemplary golf club grip apparatus 10 when glove 240 is received by the hand. Body 220, in this implementation, is disposed entirely on the palm side of the hand and body 120 does not directly engage the fingers or the dorsal side of the hand. Body 220 is coterminous with the purlicue, in exemplary golf club grip apparatus 200. There is no webbing between thumb and forefinger, in exemplary golf club grip apparatus 200.

Note that body 220 is internal within glove 240, in this implementation, so that portions of palm side 243 of glove 240 are interposed between body 220 and the handle of the golf club, such as handle 97 of golf club 90, and portions of glove 240 are interposed between body 220 and the palm of the golfer. In some implementations, chamber 242 may be configured to retain body 220 within chamber 242 while allowing body 220 to be inserted into chamber 242 and withdrawn from chamber 242. Such implementations allow for replacement of body 220 as needed. In such implementations body 220 may be enclosed in chamber 242, for example, by a hook and loop fastener (not shown) operably disposed about chamber 242. In other implementations, chamber 242 may be configured to retain permanently body 220 within chamber 242 so that body 220 is not removable from chamber 242. In these implementations, body 220 may be enclosed within chamber 242 by stitching so that there is no ingress or egress communication with chamber 242.

The foregoing discussion along with the Figures discloses and describes various exemplary implementations. These implementations are not meant to limit the scope of coverage, but, instead, to assist in understanding the context of the language used in this specification and in the claims. The Abstract is presented to meet requirements of 37 C.F.R. § 1.72 (b) only. Accordingly, the Abstract is not intended to identify key elements of the apparatus and methods disclosed herein or to delineate the scope thereof. Upon study of this disclosure and the exemplary implementations herein, one of ordinary skill in the art may readily recognize that various changes, modifications and variations can be made thereto without departing from the spirit and scope of the inventions as defined in the following claims.

The invention claimed is:

1. A golf club grip apparatus, comprising:

a body;

a surface defined by the body, the surface configured to engage biasingly only portions of a palm of a hand about a thenar region thereof;

an opposing surface defined by the body and oriented opposite the surface, said opposing surface configured to engage a handle of a golf club, the opposing surface being generally flat to level out the thenar region of the palm; and wherein the body is configured to fill at least portions of a void between the thenar region of the palm of the hand and the handle of the golf club formed by the golfer gripping the handle of the golf club, the body is configured to avoid contact with the thumb and fingers and the hypothenar region of the palm.

2. The apparatus of claim 1, wherein the body has a maximum width at an end configured to be coterminous with a purlicue of the hand and tapers to an opposing end formed as a vertex configured to be disposed generally between a radial longitudinal crease and a proximal transverse crease of the palm.

3. The apparatus of claim 1, wherein the body has a maximum thickness at an end configured to be coterminous with a purlicue of the hand, the thickness narrowingly approaching an opposing end.

4. The apparatus of claim 1, further comprising:

a glove in cooperation with the body configured to engage the body with portions of the golfer's thenar region.

5. The apparatus of claim 4, wherein the body is received within a chamber defined by the glove.

6. The apparatus of claim 4, wherein the body is disposed externally about the glove.

* * * * *